United States Patent [19]

Graham et al.

[11] 4,396,655

[45] Aug. 2, 1983

[54] METHOD OF SEALING A GLASS CONTAINER WITH A THIN MEMBRANE CLOSURE

[75] Inventors: Paul W. L. Graham; Ronald W. Bradley; Norman M. Bouder, Jr., all of Toledo, Ohio

[73] Assignee: Owens-Illinois, Inc., Toledo, Ohio

[21] Appl. No.: 355,491

[22] Filed: Mar. 8, 1982

[51] Int. Cl.[3] ..... B65D 41/20; B65D 7/28; B65D 3/00

[52] U.S. Cl. ..... 428/35; 53/478; 53/69; 53/308.4; 53/232; 53/DIG. 2; 53/287; 53/429; 53/441

[58] Field of Search ..... 53/478; 156/69, 308.4; 215/232, DIG. 2; 427/287; 428/429, 441, 35

[56] References Cited

U.S. PATENT DOCUMENTS 3,249,246 5/1966 Mahoney ..... 65/30.1 X
3,998,985 12/1976 Kitaj ..... 428/441 X
4,135,014 1/1979 Salensky et al. ..... 428/429 X
4,260,438 4/1981 Dembicki et al. ..... 156/69

FOREIGN PATENT DOCUMENTS 2833334 6/1979 Fed. Rep. of Germany .

*Primary Examiner*—Robert A. Dawson
*Attorney, Agent, or Firm*—Thomas L. Farquer; M. E. Click; D. H. Wilson, Jr.

[57] ABSTRACT

This invention relates to a method of sealing a container mouth, and especially the mouth of a glass container, and the glass container so sealed. The method involves oxidizing the container rim portion, applying a first annular thin coating of an organo-functional silane compound and then a second annular thin coating of an ethylene acrylic acid copolymer over the first coating on the rim portion. A thin imperforate membrane such as aluminum foil having a thermoplastic sealing material such as Surlyn copolymer over its sealing surface is sealed to the container rim portion with heat and pressure.

22 Claims, 2 Drawing Figures

METHOD OF SEALING A GLASS CONTAINER WITH A THIN MEMBRANE CLOSURE

BACKGROUND OF THE DISCLOSURE

The present invention relates to the preparation of a glass sealing surface for sealing to a thin membrane capable of effecting a liquid-tight seal. The method is especially useful for sealing the mouth portion of a glass container which has been treated to facilitate durable and long-term sealing preferably by means of a laminate of aluminum foil and a thermoplastic polymer.

It is fairly common to form heat-activated seals on plastic containers using thin membrane-type sealing materials. Generally, a membrane, which may be comprised of a laminate of aluminum foil and a thermoplastic polymer is forced against the mouth of the plastic container under heat and pressure so that the container and sealing laminate form polymer-to-polymer adhesive contact. While the method is of considerable benefit in sealing plastic containers, it cannot be used in sealing glass containers since only short-term seal life can be obtained unless a supplemental closure is employed. Poor adhesion between the polymer and the glass results in leakage especially in packing many types of hot fill and acidic products.

SUMMARY OF THE INVENTION

The sealing surface of the mouth portion of the glass container is initially flame treated to oxidize any and all surface coatings which may exist thereat. Such coatings may be present where the exterior surfaces of the container body portion have been treated with thin films of metal oxide and lubricous organic materials for example. The mouth or rim portion of the container is next treated with an organo-functional silane compound applied over the heated rim surface in a fully annular pattern and then treated with a second coating of an ethylene acrylic acid copolymer which is applied over the cooled surface in a similar annular pattern. The silane and copolymer treatments are conducted successively in the stated order after which the container is ready to be sealed with a thin imperforate membrane.

The seal is formed, after filling the container with product, by pressing the thin imperforate membrane comprising a film layer of thermoplastic ionomer material such as Surlyn over the sealing surface and heating the thermoplastic ionomer material to form a strong glass to thermoplastic adhesive bond. The thin membrane preferably is comprised of an aluminum foil/thermoplastic film laminate although it may also be comprised of paper/polymer laminate, a polymer sheet or a laminate of two or more layers of polymers, metal foil and/or paper. The only requirement is that the polymeric material of the thermoplastic type face the annular pattern of the preferred-ethylene acrylic acid copolymer on the container sealing surface for heat and pressure sealing compatible with the contained product.

A specific object of the present invention is to provide an improved method of preparing the sealing surface of a glass container to form a more durable liquid-tight seal. The method involves first heating the sealing surface such as by flame treatment to oxidize the material existent thereon, coating the sealing rim surface with a thin coating of an organo-functional silane compound, and then applying a second thin coating of a thermoplastic ethylene acrylic acid copolymer. The sealing surface is then sealed, after filling the container, using a thin imperforate membrane having a thin coating of ethylene acrylic acid copolymer over its sealing surface, the rim portion of the container being heated above the softening point temperature of the latter thermoplastic sealing material to effect the vacuum-tight seal. Thus, a durable long-lived liquid-tight vacuum seal is achieved by the plastic-to-glass bonding.

A further object of the present invention is to provide a method of closing a glass container in which a dual-layer adhesive coating is placed on the rim of the container and a thin metal foil having a thermoplastic sealing layer thereon is pressed against the container rim employing heat and pressure to effect the seal.

With regard to the sealing of glass containers it is known to use metal foils such as aluminum having a thermoplastic coating thereon and applying same to the container mouth employing heat and pressure. In this process the foil is pressed against the container rim for a sufficient period of time for the thermoplastic coating to adhere to the container rim. Normally either conduction or induction heating is used for such sealing to join the metal foil to the glass; however, such seals are only practical for dry contents and not liquids filled by hot-fill techniques. Further sealing materials must be used which are approved for such sealing purpose in contact with a wide variety of foodstuffs and beverages. While it is known to use a silane material on the glass rim for sealing purposes to a metal foil, the adhesion agents previously disclosed are either not approved for food use, or present a sticky or tacky condition not readily storable without special care, or requiring an undue time delay for aging before acceptable sealing. Such use of a silane is broadly disclosed in West German Patent Document P 28 33 334.8-23 published June 23, 1979 to Gerresheimer Glas A. G.

PREFERRED EMBODIMENT

Figure 2:
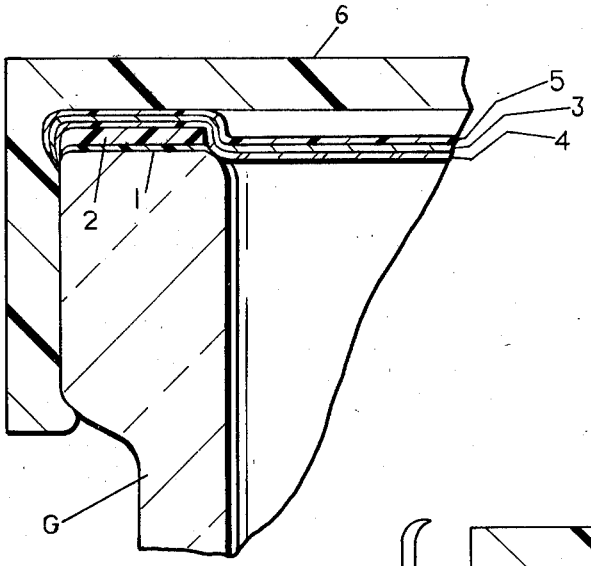
FIG. 2 is a fragmentary vertical sectional view of the upper portion of a glass container illustrating the metal foil/thermoplastic film membrane sealed to the sealing surface of the container with the snap cap in place.

This invention relates to the preparation of a glass container for use with a seal of the membrane-closure type which is liquid-tight to serve as a replacement for the conventional screw cap closure for glass containers. A thin strong membrane preferably consisting of a metal foil laminate having a layer of thermoplastic polymer thereon is heat sealed to the sealing surface at the mouth of the glass container. Heat sealing is normally accomplished after filling the container by forcing the thin membrane against the glass sealing surface or lip area at a temperature slightly above the softening point temperature of the thermoplastic material but preferably below the melting point temperature. Either conduction or induction heating may be employed to attain such heat sealing usually within a short period of time where a heated platen is used. After effecting the final seal the membrane can be covered by a plastic snap-cap for protective and resealing purposes.

It has been found that in many common types of such sealing, problems of leakage can occur especially in the packaging of hot-fill and acidic type products particularly stored in high humidity conditions. Many different types of coating materials have been employed to attempt to eliminate these problems however, virtually all have been unsuccessful until the advent of the present process. Also various processes of treating the glass surfaces using sulfur oxides or decomposable fluorine compounds have been tried as disclosed in U.S. Pat. Nos. 3,249,246 and 4,260,438. All of these methods were directed at improving the sealing surface of glass containers using fluorine or sulfur oxide treatments to improve the strength and stability of the glass to polymer bonding. All require extensive processing steps and experience at least some leakage is providing liquid-tight long-term seals.

In accordance with the present invention a vacuum and liquid-tight seal capable of long-lasting storage can be provided to the mouth portion of a glass bottle or jar using a thin sealing membrane. The seal is formed by initial oxidizing treatment of the glass sealing surface to oxidize or remove any existent materials thereon. Glass containers which have been surface treated over the exterior surfaces of their body portion with combinations of thin transparent coatings are so subjected to oxidizing conditions. Frequently such containers are previously surface treated with combinations of tin or titanium oxides applied in the form of so-called hot-end treatments while the containers possess considerable heat of formation, and polyethylene, oleic acid or other organic coating materials applied in the form of so-called cold-end treatments. The containers, preferably wide-mouth bottles and jars, are conducted under a lineal series of ribbon-type gas burners which produce an oxygen-rich gas flame to oxidize or burn off the organic constituents of the aforesaid treatments on the upper lip or so-called finish portion of the containers thus making them water receptive or essentially hydrophilic at such area. The containers are heated to a temperature of up to about 180° F., at the finish portion during this phase of the process to accelerate the oxidation and hasten the drying of subsequent coatings to be immediately applied. The glass containers may have a finish area designed with a flat or crowned sealing surface adapted to accept a heat seal. The flame treatment of the finish area serves to modify and partially remove the surface treatment in that area.

The heated containers then pass under an overhead roller coating device consisting of a cylindrical rubber or other resilient material roller which is able to forcefully contact the container lip portion during its passage therebeneath. The roller is mounted transversely of the direction of container travel and is adapted to apply about a 0.1 to 2 percent solution by weight of an organo-functional silane compound in deionized water. Two such rollers are used mounted in adjacent relation over the container path. The containers are rotated through 90 degrees between each application. Two applications are used to ensure complete and thorough coverage of the lip area especially in cases where the lip is not truly planar but possessive of minor dips or valleys. The dual application is preferred although a single application may suffice upon proper selection of roller facing material and certain types of container finishes.

A preferred silane compound is Union-Carbide organo-functional Silane A-1120, N(beta-aminoethyl) gamma-amino-propyl-trimethoxysilane, which is a diamino-functional silane coupling agent used over a broad range of adhesive applications. It is manufactured and sold by Union-Carbide Corporation, Silicone Division, Danbury, Connecticut. This product is soluble in ethanol, methanol, benzene toluene, methyl cellosolve, and in water when hydrolysis occurs. It is used as adhesion promoter in certain plastisol sealants and as an additive to phenolic binders and molding compounds. It is a straw-colored liquid having a specific gravity of 1.03 (25/25° C.), a refractive index of 1.448 ($n_D$25° C.) and a flash point of 280° F. The product is dissolved in deionized water to give a one-percent solution, which is then delivered to the roll coaters. The silane coupling agent is applied as a thin film over the lip sealing surface, Union-Carbide A-1120 being preferred, although products A-1100 and A-174 are also suitable silanes for this purpose.

The containers are then force cooled and dried at a temperature of about 100° F., and not in excess of about 140° F. The initially-coated silane-bearing containers are then passed under a second pair of overhead roller coaters which apply a coating of bonding agent over the silane coating.

As in the case of the application of the silane the containers are successively passed beneath the pair of roll coaters mounted in tandem in close proximity. The containers are again rotated 90 degrees between each application to ensure that the bonding agent fully covers the first silane coating and does not miss a low spot on the container lip area. The bonding or adhesive agent preferably consists of an ethylene acrylic acid copolymer in the form of a water emulsion. A Dow EAA dispersion which is called Polyethylene No. 483 made and sold by Dow Chemical Company, Midland, Michigan, has most desirable property profiles. This EAA coating combines the strength and chemcial resistance of polyethylene and the high degree of adhesion and functionality of free carboxylic acid groups. The dispersion offers exceptional performance advantages in priming and laminating operations. The EAA material as applied comprises about a 25% by weight solids dispersion in water. The material bonds and seals at relatively low temperatures and provides flexible coatings high in tensile strength, clarity and gloss. The coating provides excellent water resistance and outstanding adhesion to metal foil, paper, nylon and polyethylene. The material also complies with FDA regulations for paperboard coatings and adhesives. In addition, the material is an inherent film former requiring no supplemental heating other than that required to dry the applied coatings. As stated, the heat-softenable Dow EAA product (ethylene acrylic acid) ethylene copolymer is applied as a second thin film over the silane treated finish. Dow Polyethylene 483 and similar products are suitable adhesive materials.

The silane coating is extremely thin being applied from a dilute aqueous dispersion. The second coating of EAA dispersion is thicker having a thickness ranging from about 2 to 20 microns, although a narrower intermediate range of thickness of about 5 to 11 microns is preferred. The dual coating is fully contiguous with and uninterrupted over the annular lip area.

In addition to the use of the EAA dilute dispersions as the bonding agent, a hot melt material such as Product No. 3746 made and sold by 3M Company, St. Paul, Minn. may be similarly employed as a coating over the silane material. While the EAA material is preferred the hot melt material can be used as an alternative to provide comparable results.

The particular bonding agent may require a forced drying and a cooling step before the containers can be palletized or placed in a carton for shipment. The use of a hot melt adhesive would not require a drying step as may be the case with EAA dispersions.

The coated containers bearing the first and second coatings over their lip regions are then transported to the product filling line for subsequent processing. The coated finish area of the containers do not require any special handling or protective covering techniques, and may be stacked as necessary or desired in conventional processing.

Either cold or hot filling techniques may be used to fill the containers with product. Also products which are considered somewhat difficult to pack with liquid-tight seals such as citric juices can be packed with the present process providing long-lasting storage life.

The containers are filled with the selected product which may be at an elevated temperature ranging from about 190° to 210° F., for example. A preshaped Surlyn-coated aluminum foil laminated lid is preferably used to seal the containers. The lid has a recessed central panel comparable in diameter to the container mouth diameter, and a thermoplastic sealing material such as a Surlyn ionomer resin over its sealing surface.

The Surlyn material is preferably a duPont Surlyn Grade No. 1652 of the zinc type having a melt index of 5.0 and an extrusion melt temperature of 310° C. (590° F.) which can be applied to a paper or foil substrate. While there are many varieties of Surlyn formulations, substrate adhesion is the key factor governing the choice of Surlyn ionomer resin grade. All of the zinc type ionomers show excellent aged adhesion to unprimed foil as well as paper substrates. All grades of Surlyn ionomer resin are based on either zinc or sodium ions. The zinc ionomers are most desirable where products high in water or alcohol content are to be packaged. The sodium ionomers generally have a higher moisture content than zinc resins and can exhibit a hazy film appearance on extended exposure to water. All grades of Surlyn ionomer resin have superior oil resistance in comparison to polyethylene and other common olefin copolymers. Surlyn Grade No. 1652 has good oil resistance and excellent toughness and abrasion resistance for packaging many types of aggressive products.

The overall heat-sealing properties of Surlyn ionomer resins are outstanding and are generally characterized by low temperature sealability, high melt strength and ability to seal through contamination, broad sealing range, and high seal strength. Ionomers provide greater fusion seal strength than most polyolefin materials. The Surlyn Grade No. 1652 provides a Vicat softening point of 80° C. (176° F.) which is one measure of low temperature sealability. This resin has a heat-seal interface temperature of 132° C. (269° F.) and a melt viscosity at shear rate of 0.1 sec $-1$ of 10 lb. -sec/sq.in. Grade 1652 has a low viscosity value and thus a high flow to assist sealing through liquid-type contamination. As stated, the zinc ionomers provide higher seal strength at lower seal temperatures than the sodium resins.

Surlyn Grade No. 1652 is an extrudable ionomer resin which is a metal salt of an ethylene/organic acid copolymer of the zinc type available in pellet form for use in conventional extrusion equipment designed to process polyethylene resins. Surlyn ionomer resins are approved under FDA regulations for use in packaging foods subject to extraction specifications on the finished food-contact article. While the Surlyn Grade No. 1652 is preferred, Grade Nos. 1702 and 1705 which are ionomer resins for flexible packaging may also be used in the present invention.

The aluminum foil/thermoplastic ionomer resin laminate is employed to seal the container mouth using conduction or induction heating to soften the Surlyn ionomer resin sealing layer and the bonding agent on the lip area so that they fuse together in a fusion type reaction. Sealing temperatures are effected in the range of about 330° to 420° F. using heat and pressure on the lid-lip area. A heated platen may be used to apply uniform top pressure of about 40 to 90 psi gauge to the flexible coated foil lid during the fusion cycle for a brief period of about ½ to 1½ second. The foil lid is preshaped with a central recess to assist in aligning the lid and to reduce stress on the bond as the seal and the contained product cools in the case of hot packing. The top pressure can be created by a capping machine supplying a combination of both heat and pressure. Following sealing of the lid to the container, the containers are cooled to ambient temperature desirably using a cooling tunnel which sprays progressively cooler water onto the containers. The cool containers may then be checked for any leakage and labeled as desired.

An aluminum foil lid, or a lid of other flexible material with suitable barrier properties such as Mylar film, coated on the side contacting the treated finish area with a heat sealable material, maybe used as the closure. A thin alumimum foil, coated on one side with one of the Surlyn materials supplied by duPont, is most desirable for the lidding material. Preferably the foil has a 1½ to 2½ mil thickness. The foil can be also coated with an EAA bonding agent such as the Polyethylene No. 483 applied over the glass finish as an exterior coating, providing two similar materials for fusion bonding. The subject method of sealing provides a practical heat-sealable closure for glass containers for use with high moisture containing products, especially products which are hot-filled such as citric fruits and juices.

Figure 1:
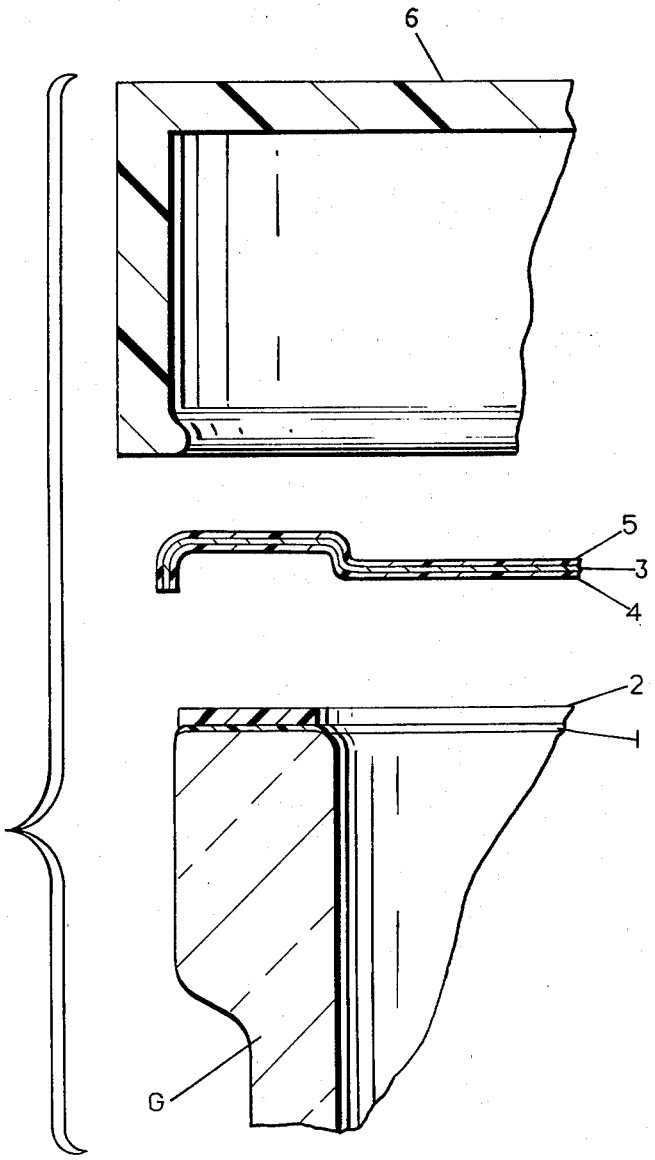
FIG. 1 is an exploded view of the metal foil/thermoplastic film membrane and snap cap for sealing a glass container.

FIG. 1 illustrates the various components of the glass container sealing construction in disassembled relation. FIG. 2 illustrates the components of the sealed container. The first layer or film 1 of silane compound is adhered to the lip area of the glass container G. The second layer or film 2 of EAA dispersion is deposited over the first layer. Metal foil membrane 3 has a Surlyn ionomer layer or film 4 which is fusion sealed to film 2. The metal foil may have a paper or other coating 5 adhered to its exterior surface. The snap cap 6 may be optionally used to cover the foil seal.

Samples of the sealed containers have been tested under vacuum and been found to withstand more than 25½ inches of mercury vacuum without leakage. Such samples were sealed using the aforesaid preferred sealing constituents as thin coatings intermediate the glass finish and an aluminum foil lid. As desired, the sealed containers can be covered with a thermoplastic snap cap, such as those commonly made of polyethylene, which serves to protect the foil closure from puncture or damage and to permit resealing of the container.

Extensive sealing tests have been made using wide-mouth glass jars comprised of soda-lime-silica glass as the containers. Pint jars having 16 ounce capacity and a rounded crown-type lip area were coated with the silane and EAA dispersion coatings. The jars were first treated over the lip area with the 1% A-1120 silane and then with the EAA coating having a 75 melt index. The jars were then sealed using a 2.5 mil Surlyn coated aluminum foil made by RJR Archer Company, Winston-Salem, NC. The seals were made using a heated platen-head capping apparatus at about 400° F. over a period of about 1.2 seconds and at 85 psig pressure. As stated, the sealing pressure can be varied from about 40 to 90 psig.

Twelve of twelve jars which had been previously filled with 210° F. water passed tests of 7 inches of mercury vacuum plus 26½ inches of mercury vacuum without leaks. Such tests were conducted periodically and successively and no leakage of the containers was observed over a substantial period of time.

Eleven of twelve jars which had been filled with 210° F. orange juice passed the 7 inches of mercury vacuum plus the 26½ inches of mercury vacuum tests. One jar passed the 7 inches of mercury vacuum test but failed the 26½ inches of mercury vacuum test when leakage was observed.

Further, twenty-one of twenty-one samples of filled and sealed glass jars coated over their lip area with silane and EAA Product No. 483 having a 300 melt index which had been previously filled with 190° F. water were stored 169 days inverted in beakers in a 100° F. room without leakage. Also no leaks were observed after 7 inches of mercury vacuum was applied.

The following water absorption results were obtained on several adhesive materials which have been considered for glass container sealing.

Glass slides were taken as the substrate for depositing the adhesives and measuring their water absorption. The two materials compared were ethylene acrylic acid copolymer (EEA) and polyvinyl butyral copolymer (PVB), the former being the preferred material of this invention.

| Condition | Material | Weight Gain Wt % |
|---|---|---|
| (1) Slides above water- | EAA | 0.01 |
| 2 days at 100° F. | PVB | 0.6 |
| (2) Slides immersed in | EAA | −0.4 |
| deionized water- | PVB | 6.3* |
| 2 days at 100° F. | | |
| (3) Slides above water- | EAA | −0.5 |
| 2 days at 36° F. | PVB | 1.1 |

*(PVB range 3.7 to 8.3)

Thus, very little water absorption by EAA coatings was observed.

In another experiment, coated slides were immersed in denatured alcohol for 1 day at 100° F. The PVB coating was completely dissolved and the EAA coating was softened.

The sealed foil closure may have a pull tab at one peripheral region of its edge to facilitate opening of the container. Normally the closure can be fully or partially removed by upward angular tensive force applied to the closure.

Various modifications may be resorted to within the spirit and scope of the appended claims.

What is claimed is:

1. The method of sealing a container mouth, said mouth consisting of glass and having an upper rim portion, comprising the steps of heating at least the container rim portion to an elevated temperature to oxidize any existent materials thereon, applying a first thin coating of an organo-functional silane compound to said rim portion, applying a second thin coating of an ethylene acrylic acid copolymer over said first thin coating of said silane compound on said rim portion, pressing a thin imperforate membrane comprising a thermoplastic sealing material against the said second thin coating of ethylene acrylic acid copolymer, and heating at least said rim portion to a temperature above the softening point temperature of said thermoplastic sealing material to seal said thin membrane to said rim portion in liquid-tight relation.

2. The method in accordance with claim 1, wherein the thermoplastic sealing material of said thin imperforate membrane comprises a thermoplastic ionomer material adhesively joined to the sealing surface of a thin sheet or foil selected from the group consisting of metal, plastic and paper.

3. The method in accordance with claim 1, wherein the said container rim portion comprises the mouth extremity of a glass bottle or jar which is heated to a temperature up to about 180° F.

4. The method in accordance with claim 1, wherein said container rim portion is comprised of a soda-lime-silica glass.

5. The method of sealing an imperforate thermoplastic film or metal foil to the mouth portion of a glass container comprising the steps of heating at least the mouth rim portion of said glass container to an elevated temperature up to about 180° F. to oxidize any existent materials thereon, applying a first thin coating of an organo-functional silane compound to the heated rim portion of said glass container, cooling the heated rim portion of said glass container to a temperature not in excess of about 140° F., applying a second thin coating of an ethylene acrylic acid copolymer over the said first thin coating of silane compound, filling the said glass container with product, pressing a thin imperforate membrane having a third thin coating of thermoplastic ionomer material against the rim portion of said glass container while heating said third coating to a temperature above the softening point temperature of said thermoplastic ionomer material, whereby said thin imperforate membrane is securely adhered to said rim portion in vacuum-tight relation.

6. The method in accordance with claim 5, wherein said second thin coating of ethylene acrylic acid copolymer is applied to said rim portion in the form of a water emulsion.

7. The method in accordance with claim 5, wherein said third thin coating of thermoplastic ionomer material is adhered to said membrane and comprises a metal salt of an ethylene/organic acid copolymer of the zinc or sodium type.

8. The method in accordance with claim 5, wherein said first and second thin coatings are successively applied to said rim portion with resilient roller coaters adapted to uniformly press against said rim portion.

9. The method in accordance with claim 5, wherein said first thin coating of an organo-functional silane compound comprises about a 0.1 to 2 percent by weight solids dispersion in water.

10. The method in accordance with claim 5, wherein said second thin coating of ethylene acrylic acid copolymer comprises about a 25% by weight solids dispersion in water.

11. The method in accordance with claim 5, wherein said imperforate thin membrane comprises a disk-shaped aluminum foil member having a recessed central panel.

12. The method in accordance with claim 11, wherein said imperforate thin membrane has a pull tab at one peripheral portion.

13. The method of sealing a thin imperforate thermoplastic film or metal foil to the mouth portion of a glass container comprising the steps of heating at least the mouth rim portion of said glass container to an elevated temperature up to about 180° F., applying a first thin coating of an organo-functional silane compound to the heated rim portion of said glass container, said silane compound being in the form of about a 0.1 to 2 percent by weight solids in an aqueous dispersion, cooling the heated rim portion of said glass container to a temperature not in excess of about 140° F., applying a second thin coating of an ethylene acrylic acid copolymer over the said first thin coating of silane compound on said rim portion, said copolymer being in the form of about a 25% by weight solids in an aqueous dispersion, filling the said glass container with product employing either a hot or cold filling process, pressing a thin imperforate membrane having a third coating of thermoplastic ionomer material comprising a metal salt of an ethylene/organic acid copolymer against the dual-coated rim portion of said glass container while simultaneously heating same to a temperature above the softening point temperature of said thermoplastic ionomer material, whereby said thin membrane is securely adhered annularly to said rim portion in vacuum and liquid-tight relation.

14. The method in accordance with claim 13, wherein said first and second thin coatings are successively applied to said rim portion with resilient roller coaters adapted to uniformly press against said rim portion.

15. The method in accordance with claim 13, wherein each of said first and second thin coatings are applied with successive dual applications made at right angles to each other with resilient rollers to ensure continuous annular coverage of said rim portion.

16. The method in accordance with claim 13, wherein said imperforate thin membrane comprises an aluminum foil member having a recessed central panel and the thermoplastic ionomer material comprises a metal salt of an ethylene acrylic acid copolymer of the zinc or sodium type applied to the sealing surface of said membrane.

17. The method in accordance with claim 13, wherein said thin imperforate membrane is sealed to said rim portion with heating of the multiple coatings to a temperature ranging from about 330° to 430° F., and with a top pressure ranging from about 40 to 90 psig for a period of about $\frac{1}{2}$ to $1\frac{1}{2}$ second.

18. A sealed glass container made in accordance with the method of claim 5.

19. A sealed glass container made in accordance with the method of claim 13.

20. A sealed glass container made in accordance with the method of claim 17.

21. A glass container adapted to sealing its mouth portion with a thin imperforate thermoplastic film or metal foil comprising an open-mouth rim portion which has been heated to a temperature of about 180° F. to oxidize the rim surface area, a first thin coating of an organo-functional silane compound applied over the heated rim portion of said glass container, and a second thin coating of an ethylene acrylic acid copolymer applied over the said first thin coating of silane compound adapted to be sealed to said thermoplastic film or foil by heat and pressure to form a liquid-tight long-lasting seal.

22. A sealed glass container made in accordance with the method of claim 1.

* * * * *